United States Patent [19]

Carlson

[11] Patent Number: 4,765,542

[45] Date of Patent: Aug. 23, 1988

[54] LIQUID MISTING ATTACHMENT FOR SUNBATHER'S CHAIR

[76] Inventor: Daniel R. Carlson, Rte. 3, Box 32 C Enter Ave., Chico, Calif. 95926

[21] Appl. No.: 147,146

[22] Filed: Jan. 22, 1988

[51] Int. Cl.[4] ..... A47C 7/74; B05B 17/00

[52] U.S. Cl. ..... 239/289; 239/271; 297/180; 4/602

[58] Field of Search ..... 239/207, 211, 266, 271, 239/279, 289, 268, 269, 547; 297/180, 217; 128/376, 377, 400; 4/599, 600, 602, 603

[56] References Cited

U.S. PATENT DOCUMENTS

| | | | |
|---|---|---|---|
| 2,770,812 | 11/1956 | Whiteside | 239/289 X |
| 3,295,886 | 1/1967 | Goldmerstein | 297/180 |
| 3,332,091 | 7/1967 | Greer | 4/603 |
| 3,625,434 | 12/1971 | Kitover | 239/289 |
| 3,688,775 | 9/1972 | Raymann | 239/289 X |
| 3,997,927 | 12/1976 | Culligan | 5/421 X |
| 4,548,357 | 10/1985 | Schmidt | 239/289 |
| 4,648,143 | 3/1987 | Breaux et al. | 239/289 X |

*Primary Examiner*—Andres Kashnikow
*Assistant Examiner*—Mary Beth O. Jones

[57] ABSTRACT

The invention provides a manually controlled, self-contained liquid misting attachment for web covered folding lounge chair and web covered folding chairs useful for sunbathing. A tubular pliable H-frame fits the chair frame and is attached by retainers. A pressurized water tank supplies liquid controllably to the H-frame and to spaced adjustable mist-producing heads in paralleling surfaces of the H-frame conduits. The sunbather, reclining on a lounge or sitting on a chair to which the liquid misting attachment is fastened, can selectively apply misted water or sun effecting liquids to his or her body by manually pressurizing a spring biasing normally closed control valve.

6 Claims, 3 Drawing Sheets

LIQUID MISTING ATTACHMENT FOR SUNBATHER'S CHAIR

BACKGROUND OF THE INVENTION

1. Field of the Invention

This invention relates to liquid spraying devices attachable to lounge chairs and chairs, the devices designed for cooling or spraying a protectant during sunbathing. The present invention is particularly directed towards equipment sufficiently flexible to be foldable when attached to a folding lounge chair or a folding chair and maintain operational efficiency when unfolded for use. The invention incorporates a self-contained plumbing and pressure system designed to spray a mist of liquid onto a sunbather. The mist is used as a cooling agent or for distributing tanning and sun screen solutions.

2. Description of the Prior Art

Past art patents were examined from a search conducted in the following classes and subclasses: 128/65, 377, 372, 366; 297/217, 180; 239/289; and 5/284, 421.

The following past-art patents are believed to be the most pertinent to the invention:

A patent issued to Goldmerstein on Jan. 3, 1967, U.S. Pat. No. 3,295,886 shows a chair with an electric fan and liquid soaked wicks to aid in cooling the user.

A patent issued to Raymann, U.S. Pat. No. 3,688,775, on Sept. 5, 1972 discloses an air mattress having a conduit for selectively spraying water.

The Kitover patent issued on Dec. 7, 1971, U.S. Pat. No. 3,625,434 shows a lounge chair being fed pressurized water from a hose and using a tubular frame with water nozzles to spray a mist of water.

On May 1, 1979, Carpenter received a patent numbered U.S. Pat. No. 4,151,618, which teaches a water-impervious flexible base sheet with a pillow.

A patent issued to Culligan on Dec. 21, 1976, U.S. Pat. No. 3,997,927, discloses a mat of compressible foam with a perforated water conduit at one end.

The patent issued to Breaux on Mar. 10, 1987, U.S. Pat. No. 4,648,143, shows a flexible sheet with a flexible water conduit.

To the best of my knowledge, the above patents are the most pertinent to my invention. In view of the past art patents and what is available on the market, it is clear there have been attempts to provide portable sunbathing apparatuses having cooling means for sunbathers in the past. However, it is known that many people sunbathe at beaches, parks and other locations where water supply hoses and electric extension cords are not available for use by the public. Several of the above patented devices rely on such hoses and cords to assist in cooling the sunbather. Although other devices shown were somewhat less reliant on such hookups, the sunbather would still be required to find a sometimes large supply of fresh water and haul it in containers or other means to fill his device. Fresh water is not always readily obtainable on ocean beaches, consequently a sunbather may have to choose between soaking in salt water, hauling heavy containers of water, or not using the cooling feature of his device at all.

SUMMARY OF THE INVENTION

Therefore, in practicing my invention, I have developed a liquid misting attachment for outdoor style folding frame lounge chairs and folding frame chairs of the type normally using webbing as covering. The liquid misting attachment is light weight, self-contained, and sufficiently flexible to remain attached when the lounge or chair is folded. As these particular lounges and chairs are also light-weight, the entire package is foldable for easy transportation. With the liquid misting attachment installed the lounges and chairs become independent operational units. Each have a self-contained plumbing system structured with a pressure tank, a manually operated air pump, and a flow valve. Flexible conduits and directable spray nozzles are also provided. The plumbing and pressure system is designed to allow the tank to be supplied with a small amount of water or a tanning oil solution at a convenient location, such as a home or an apartment hose bib. The sunbather can pressurize the pressure tank by means of the manually operated air pump, fold up the chair, and easily transport it to any desired location where the chair is unfolded and positioned in a sunny area to be used. As an individual sunbathes, he or she may become uncomfortably hot. When this occurs he or she presses the handle of the spring biased flow valve and is sprayed with a cooling mist of the elected liquid for only as long as the valve is held open. The spray nozzles can be manually rotated in different directions to allow the sunbather to designate the areas of his or her body on which the mist is to be directed or not to be directed. The invention does not rely on an outside water supply hose for water or pressure; however, I have provided for a water supply receiver connector to allow connection of a pressurized outside water supply, such as a garden hose for example.

The familiar folding mechanics and seating configuration traditional to folding lounges and lawn chairs are retained with my device attached. Also for familiarity, the pressure tank and air pump are comparable to those used in hand held garden weed sprayers. In both the lounge and the chair attachments, the principle, the fittings, and the structure of the plumbing system are nearly identical, except for certain necessary different conduit lengths.

Therefore, the principal object of my invention is to provide an attachment to a portable chair for sunbathers with a self-contained plumbing and pressure system for misting liquids.

Another object of my invention is to provide a tanning chair with the means to dispense tanning or sun screen solutions onto selected regions of a sunbather's body.

A further object of my invention is to provide a self-contained misting attachment for a chair having an optional hook up for a pressurized outside water supply source.

A still further object of my invention is to provide an attachment to a lounge or lawn chair which can make them useful as misting chairs or they can be used as conventional lawn or lounge chairs when misting is not desired.

Other objects and advantages of my invention will become better understood with a reading of the specification and considering the numbered parts therein with similarly numbered parts shown in the included drawings.

Figure 1:
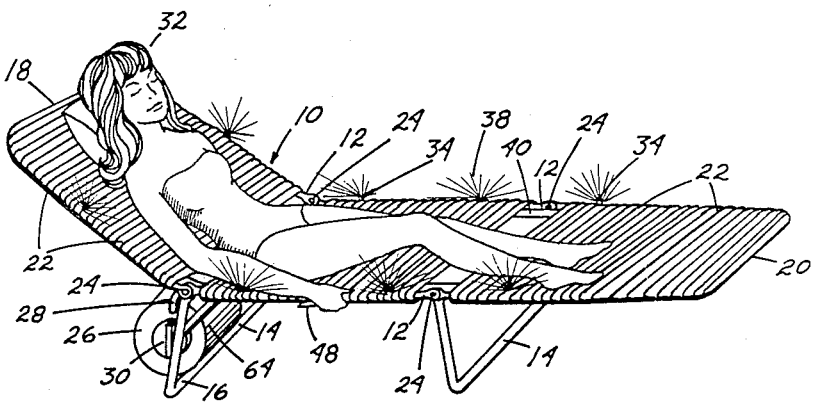
FIG. 1 is a perspective drawing of a lounging chair with the liquid misting attachment installed and being used by a sunbather.

DRAWING REFERENCE NUMERALS 10. lounge chair
12. tubular frame members
14. leg frame
16. leg frame cross member
18. head
20. foot
22. webbing
24. pivotal attachment
26. pressure tank
28. tank output hose
30. tank cap and air pump assembly
32. sunbather
34. spray nozzle
36. riser
38. misted liquid
40. flexible conduit
42. center feeder conduit
44. input tee fitting
46. system input hose
48. spring biased flow valve
50. end cap
52. tee fitting
54. water supply receiver connector
56. receiver connection cap
58. water supply connector
60. outside water supply hose
62. water supply receiver tee
64. tank housing
66. tank housing end cap
68. housing end cap aperture
70. auxiliary air intake and safety valve assembly
72. foot air pump
74. foot air pump hose
76. tank bracket
78. tank output port
80. chair
82. chair seat
84. chair back
86. conduit ties
88. riser tap fitting
90. dotted line representative of lounge chair

DESCRIPTION OF THE PREFERRED EMBODIMENTS

Figure 2:
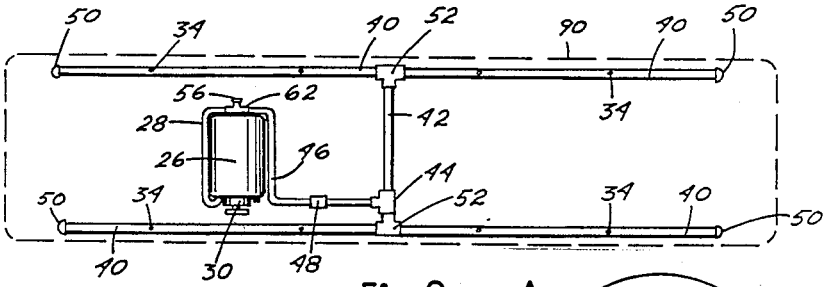
FIG. 2 shows a top plan view of the H-frame flexible conduit pipe arrangement and the self-contained plumbing system of my liquid misting attachment relatively positioned to the lounge chair represented by dash lines.
Figure 3:
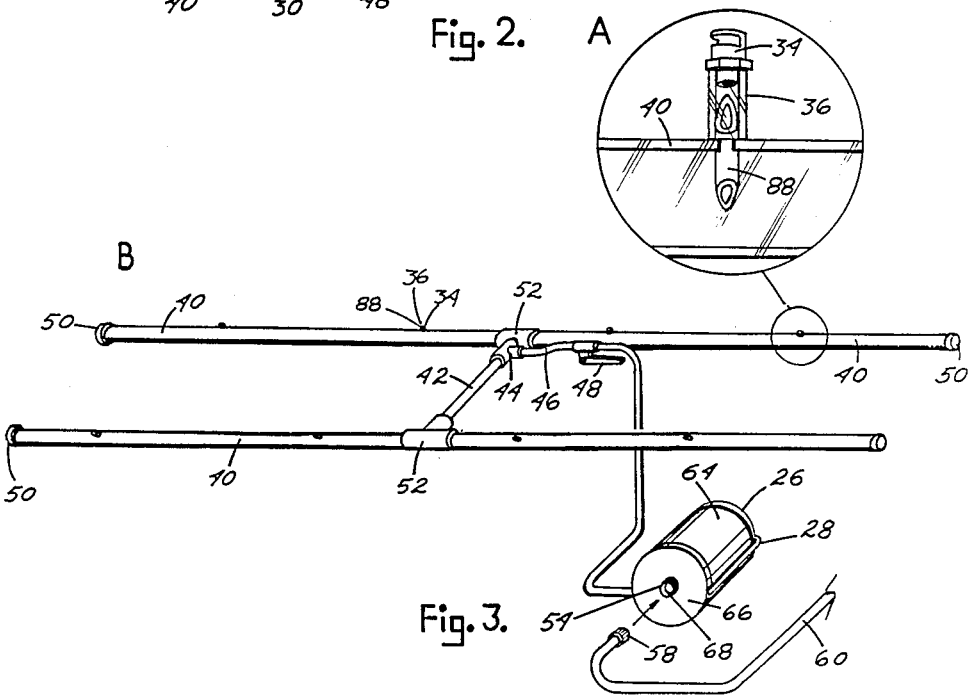
FIG. 3 is a perspective drawing of the flexible conduit H-frame with the self-contained plumbing fixtures illustrated and an enlarged view of a spray nozzle and riser assembly affixed in a flexible conduit aperture.

Referring now to the drawing at FIG. 1 where lounge chair 10 has the liquid misting attachment of this invention installed and illustrated in use. Lounge chair 10, suitable for this attachment, is structured sectionally of metal or plastic, has paralleling tubular frame members 12 affixed to leg frames 14 by pivotal attachments 24 which allow the chair to fold. Leg frames 14 are reinforced by leg frame cross member 16. Webbing 22, being plastic or cloth or any combination thereof, traverse the top of tubular frame members 12 perpendicular to the length of lounge chair 10 from foot 20 to head 18 fashioning the seat and back rest for sunbather 32. For brevity, as only one tank is involved, the word "tank" used hereinafter implies part of or association with pressure tank 26. Tank housing 64 is attached by clamps or other suitable means to leg frame 14 and leg frame cross member 16 towards head 18 in a shaded location of lounge chair 10. Pressure tank 26 is removably installed in tank housing 64. Cap and air pump assembly 30 is removably affixed to pressure tank 26 so pressure tank 26 can be filled with a liquid such as water or a tanning solution and then can be pressurized. Pressure tank 26 has tank output port 78 to which tank output hose 28 is affixed. The opposite end of tank output hose 28 is attached to additional plumbing fittings detailed in FIGS. 2 and 3. Dotted line 90 represents the lounge chair outline in FIG. 2. Tank output hose 28 supplies liquid to manually operated spring biased flow valve 48 which valves liquid to flexible conduits 40. Spring biased flow valve 48 is normally closed and a handle thereon requires maintained manual pressure to open the line for liquid to flow. Flexible conduits 40, fastened to tubular frame members 12 by conduit ties 86, are structured of plastic adequately flexible to fold with the chair and have sufficient elasticity to unfurl to original diameters upon opening the chair. Pressurized liquid coursing in flexible conduits 40 is forced through tap fittings 88 which are inserted into apertures in flexible conduits 40 and connect to risers 36. Risers 36 are structured of a plastic material possessing the same characteristics as flexible conduit 40 and terminate with nozzles 34 inserted into the ends. Nozzles 34 are adjustably held to allow turning so the pressurized liquid directed to them from risers 36, converted to misted liquid 38 (see FIG. 3A), can be controllably directed. The circled enlargement at FIG. 3B best shows the mist nozzle assemblage. Risers 36 have sharpened insert ends and additional units of the nozzle assembly (FIG. 3A) can be added by effecting a small puncher in any desired position in the surface of flexible conduit 40. Risers 36 can be repositioned to clear webbing 22 by removal and plugging the insert opening in flexible conduit 40 and reinserting risers 36 into a small puncher made in flexible conduit 40.

Figure 4:
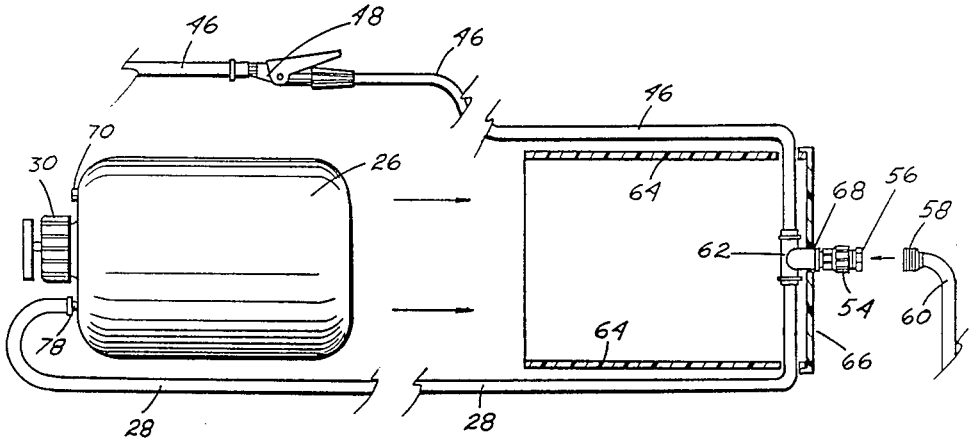
FIG. 4 is an enlarged view of the pressure tank positioned to be inserted into the tank housing, illustrated sectionally, and showing cut-offs of outflow and inflow hoses with the spring biased control valve installed in the H-frame conduit feeder hose.

Flexible conduits 40 run parallel on each side the length of lounge chair 10 and are terminated by end caps 50 at their distal ends. The paralleling sides of flexible conduits 40 are connected to tee fittings 52 located substantially centrally of flexible conduits 40. Tee fittings 52 are connected to center feeder conduit 42 which traverses the width of lounge chair 10, connecting flexible conduits 40 and forming an H-frame. Input tee fitting 44, located in center feeder 42, is connected by system input hose 46 to the output side of spring biased flow valve 48. Pressurized liquid from spring biased flow valve 48, when actuated, is fed to the H-frame system. Shown inside in a cutaway view of tank housing 64 in FIG. 4, is water supply receiver tee 62. Tee 62 passes through housing end cap 66 in housing end cap aperture 68. Water supply receiver connector 54 is positioned distally to receive water supply connector 58 of outside water supply hose 60. This arrangement provides optional pressure and water supply means to lounge chair 10. Water supply receiver connector 54 is removably capped with receiver connection cap 56. Receiver connection cap 56 must be removed prior to connection of outside water supply hose 60 and is used to close water supply receiver connector 54 when the self-contained plumbing and pressure system is in use. Pressure tank 26 feeds pressurized liquid though tank output hose 28 to water receiver tee 62 which in turn feeds system input hose 46 supplying the input side of spring biased flow valve 48. As long as sunbather 32 (FIG. 1) applies pressure to spring biased flow valve 48, spray nozzles 34 will produce misted liquid 38. Misting will stop when spring biased flow valve 48 is released.

Figure 5:
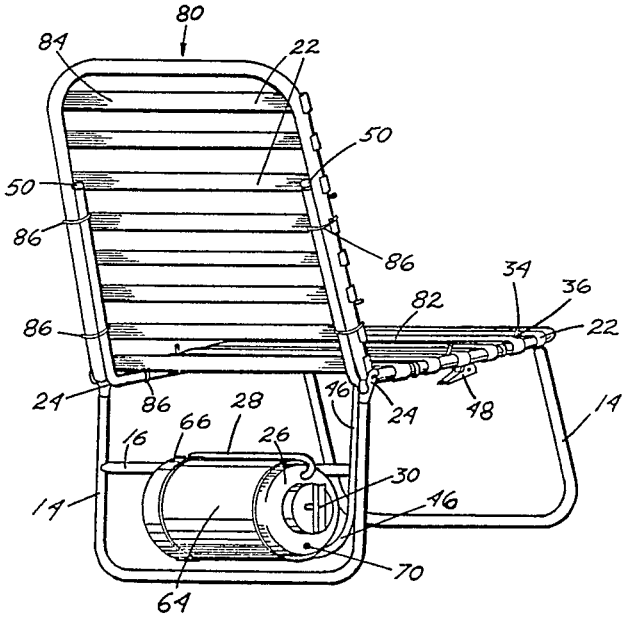
FIG. 5 is a perspective view of the liquid misting attachment fastened to a lawn-type folding chair illustrating conduit and self-contained plumbing fixture retainers.
Figure 6:
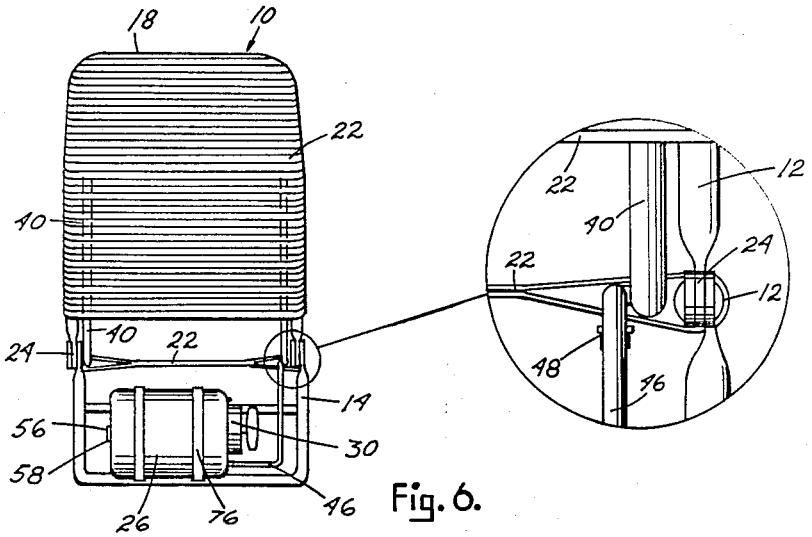
FIG. 6 is a view of the back of a lounge chair with the liquid misting attachment installed showing the unhoused pressure tank supported in a tank bracket and illustrating the flexible conduit installed between the chair webbing in an enlarged view.
Figure 7:
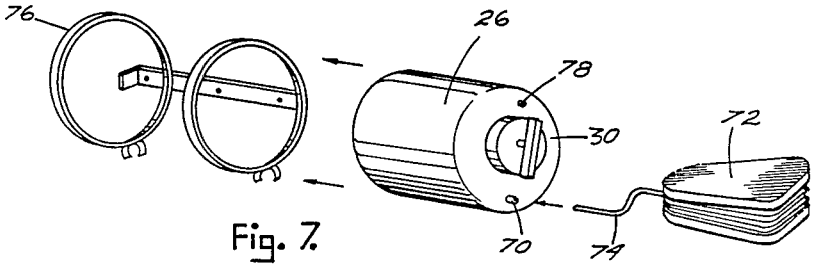
FIG. 7 shows an enlarged view of the unhoused pressure tank positioned to be inserted for installation into the tank bracket shown on the chair in FIG. 6, and illustrating a foot operated air pump as a pressurizing means.

On folding lawn chair 80 at FIG. 5, the preferred means for attaching flexible conduit 40 with conduit ties 86 around tubular frame members 12 is shown. Risers 36 extend upwardly through open spacings of webbing 22 from underneath chair seat 82 and behind chair back 84. An enlarged view at FIG. 6 shows a second method of attaching flexible conduit 40 on chairs having webbing 22 attached. In this structure, flexible conduits 40 are positioned where webbing 22 forms an opened spaced loop around tubular frame members 12. Although the FIG. 6 installation can be home-accomplished, this installation is normally for factory fabrications. FIG. 7 is an enlarged view of a second embodiment of a pressure tank mounting means showing tank mounting bracket 76 positioned to accept pressure tank 26. Also shown positioned for attachment to pressure tank 26 is optional foot air pump 72. Optional foot air pump 72 attaches to tee-fitting auxiliary air intake and safety valve assembly 70 by means of foot air pump hose 74.

Although I have described my invention in length and with details in the specification, it is to be understood that modifications may be practiced in the invention which do not exceed the intended coverage of the appended claims.

What is claimed is:

1. A self-contained liquid misting apparatus attachable to the frames of webbed folding lounge chairs and webbed folding chairs with said apparatus having supplying and pressurizing means for controllably spraying a misted liquid on a sunbather, comprising:

a flexible tubular liquid-conducting H-frame sized for attachment to said frames of said webbed folding lounge chairs and said webbed folding chairs with said H-frame having sufficient pliability to allow folding and unfolding of said webbed folding lounge chairs and said webbed folding chairs with said H-frame attached;

said H-frame having two paralleling conduits with capped terminal ends and a cross-affixed feeder conduit substantially centrally positioned, there being an access fitting in said cross-affixed feeder conduit;

said two paralleling conduits of said H-frame aligned with spaced apertures fitted with liquid misting heads along similarly faced surfaces of said H-frame specifically designated for upwardly positionment;

said liquid misting heads fastened by risers and pivotally installed in said risers for manual directional manipulation, there being means for repositioning, adding, and reducing the number of said liquid misting heads fastened by said risers;

means for fastening said H-frame to said frames of said webbed folding lounge chairs and said webbed folding chairs;

a pressure resistant liquid storage tank equipped with an outflow fitting, a tank output hose, a removable tank cap and air pump assembly, and an auxiliary air intake and safety valve assembly;

a housing for said pressure resistant liquid storage tank attached to said frames of said webbed folding lounge chairs and said webbed folding chairs;

a system input hose of operational length and size having a connector fitting connected to said access fitting in said cross-fixed feeder conduit and to said tank output hose;

a manually operational spring biased flow valve control normally closed and opened only for the period manual pressure is applied with said flow valve control supplied with fittings connected to said system input hose, said flow valve control being attached to said frames of said webbed folding lounge chair and said webbed folding chair;

an attachment by-passing said pressure resistant liquid storage tank when in use with said attachment means providing direct application of water from said external pressurized water supply into said H-frame.

2. The misting apparatus of claim 1 wherein said flexible tubular liquid conducting H-frame is structured of rubberized plastic.

3. The misting apparatus of claim 1 wherein said means for said repositioning, adding, and reducing the number of said liquid misting heads fastened by said risers is the sharpened insert end of said risers repositioned in a punched hole and the original hole plugged or glued shut.

4. The misting apparatus of claim 1, wherein said means for fastening said H-frame to said frames of said webbed folding lounge chairs and said webbed folding chairs is a multiple of appropriately sized conduit-type ties.

5. The misting apparatus of claim 1 wherein said pressure resistant liquid storage tank is filled from said external pressurized water supply by removing said tank cap and air pump assembly.

6. The misting apparatus of claim 1 wherein said attachment means by-passing said pressure resistant liquid storage tank when in use is a T-joint affixed to connect said tank output hose, to said system input hose with a leg of said T-joint fitted by threading with a removable cap, said threading compatible with the threading in the attachment fitting of a garden hose when said cap is removed.

* * * * *